United States Patent [19]

Plzak et al.

[11] Patent Number: 5,031,410

[45] Date of Patent: Jul. 16, 1991

[54] REFRIGERATION SYSTEM THERMAL PURGE APPARATUS

[75] Inventors: William J. Plzak, La Crescent, Minn.; Brian T. Sullivan, Onalaska, Wis.

[73] Assignee: American Standard Inc., New York, N.Y.

[21] Appl. No.: 482,592

[22] Filed: Feb. 21, 1990

[51] Int. Cl.[5] ..... F25B 47/00

[52] U.S. Cl. ..... 62/85; 62/475

[58] Field of Search ..... 62/475, 85

[56] References Cited

U.S. PATENT DOCUMENTS

| | | | |
|---|---|---|---|
| 1,084,265 | 1/1914 | Friedmann . | |
| 1,911,464 | 5/1933 | Pearson . | |
| 2,321,964 | 6/1943 | Zieber | 62/115 |
| 2,400,620 | 5/1946 | Zwickl | 62/115 |
| 2,577,598 | 12/1951 | Zwickl | 62/117 |
| 2,920,458 | 1/1960 | Watkins | 62/195 |
| 2,986,905 | 6/1961 | Kocher et al. | 62/475 |
| 3,145,544 | 8/1964 | Weller | 62/195 |
| 3,620,038 | 11/1971 | Muench | 62/475 |
| 4,304,102 | 12/1981 | Gray | 62/475 X |
| 4,581,903 | 4/1986 | Kerry | 62/503 |

*Primary Examiner*—Lloyd L. King

*Attorney, Agent, or Firm*—William J. Beres; William O'Driscoll

[57] ABSTRACT

Thermal purge apparatus for a chiller removes air, moisture and other non-condensibles from the chiller system refrigerant by causing chiller system refrigerant vapor to condense in a purge tank as a result of its undergoing a heat exchange relationship with a second and different refrigerant employed in a discrete purge refrigeration circuit. Chiller refrigerant circulates from the chiller condenser to, through and out of the purge tank in a free-flowing circulatory manner as a result of temperature and pressure gradients which develop between the interiors of the chiller condenser and the purge tank when the purge apparatus is in operation.

18 Claims, 4 Drawing Sheets

FIG. 1
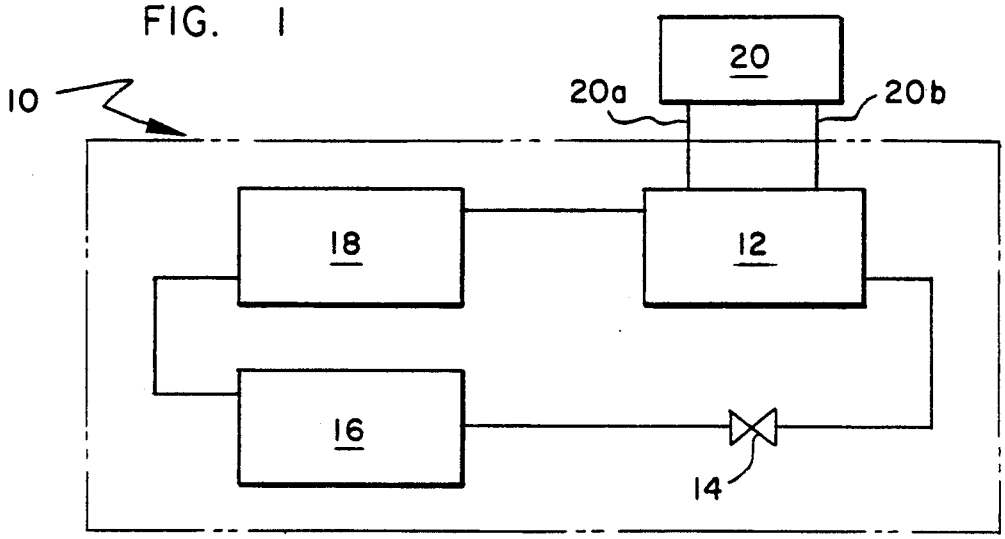
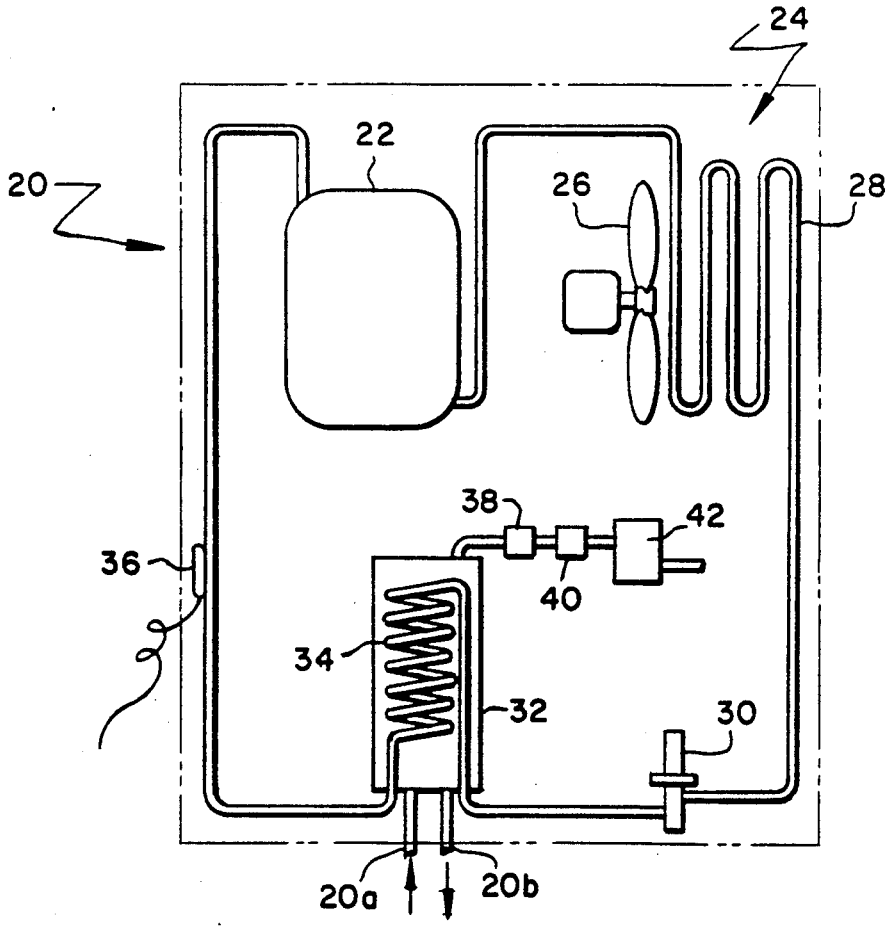
FIG. 2

REFRIGERATION SYSTEM THERMAL PURGE APPARATUS

BACKGROUND OF THE INVENTION

The present invention is directed to purge apparatus for the removal of accumulated moisture, air and other non-condensibles from the system refrigerant in chillers that provide chilled water for use in industrial processes and to comfort condition buildings. More specifically, this invention relates to purge apparatus of the "thermal" type which efficiently removes air, water and other non-condensibles from refrigerant chillers, most commonly of the centrifugal type, in a manner which minimizes the loss of chiller system refrigerant from the chiller.

Certain refrigerant chillers utilize low pressure refrigerants, such as the refrigerant commonly referred to as R11, and include components which, under certain conditions, operate at less than atmospheric pressure. This is in contrast to chillers employing "high" pressure refrigerants, such as the refrigerants commonly referred to as R12 and R22, which normally operate with condensing pressures in excess atmospheric pressure.

Because refrigerant chillers using low pressure refrigerants include components which operate at less than atmospheric pressure it is possible for moisture, air and other non-condensibles to leak into these machines through, for instance, flare fittings and gasketed surfaces located on the low pressure side of the chiller. Water vapor will also potentially enter the low pressure side of a chiller entrained in air or through chiller condenser tube leaks.

If allowed to accumulate, non-condensible elements become trapped in the chiller condenser. The presence of these elements in the condenser increases condensing pressure and therefore chiller compressor power requirements thereby reducing chiller efficiency and cooling capacity. Additionally, if this situation is untreated, chillers will typically surge, cutout or fail to start. Finally, the failure to remedy the presence non-condensibles within the chiller can lead to increased corrosion throughout the chiller.

The need therefore exists to provide purge apparatus which removes moisture, air and other non-condensibles from a refrigerant chiller. While many purge system designs exist, there continues to be a need to provide purge apparatus which efficiently expels non-condensibles from refrigerant chillers while minimizing the loss of chiller refrigerant in the process of removing such non-condensibles and which is operative independent of the operational status of the chiller with which it is used.

SUMMARY OF THE INVENTION

It is the primary object of the present invention to provide efficient purge apparatus which automatically expels non-condensibles from a refrigerant chiller in a manner which minimizes the loss of chiller system refrigerant in the purge process.

It is another object of the present invention to provide purge apparatus for a chiller which enables the chiller to operate at peak efficiency by removing non-condensibles, such as air, both when the chiller is not operating or is operating in various modes commonly known in the industry as powered cooling, heat recovery and free cooling.

It is another object of the present invention to provide purge apparatus which operates, on free-flow circulatory principles, with a chiller having components which operate at sub-atmospheric pressure thereby eliminating the need for a restriction or flow modulation device, such as a float valve or orifice, in the piping connecting the chiller condenser to the purge apparatus.

It is a further object of the present invention to provide purge apparatus which does not contribute to air or refrigerant leakage in normal operation or in a failure mode.

It is still another object of the present invention to provide purge apparatus which is operable when the chiller is not operating so as to allow the removal of accumulated non-condensibles after service, prolonged shutdown or free cooling, in order to facilitate chiller startup and operation after such periods.

It is another object of the present invention to provide purge apparatus which eliminates the use of mechanical apparatus to control the liquid refrigerant level in the purge tank and which controls the purge rate so that indications of the existence of an air leak into the chiller can be obtained in correlation with the controlled purge rate and frequency.

It is a further object of the present invention to provide purge apparatus of the thermal type which is extremely reliable and which requires low maintenance yet which is competitive, from a cost standpoint, to alternatively available purge apparatus.

It is also an object of the present invention to provide purge apparatus which is operative with 50 or 60 hertz chillers using low pressure refrigerants such as R11, R113, R123 or the like, and which is capable of field retrofit to existing chillers.

It is still another object of the present invention to provide purge apparatus which employs a discrete hermetic refrigerant circuit and a relatively high pressure refrigerant, different than the chiller refrigerant, in a heat exchange relationship with chiller system refrigerant to separate non-condensibles from the chiller system refrigerant in a tank remote from the chiller.

Finally, it is an object of the present invention to provide purge apparatus which minimizes liquid refrigerant loss during service of the purge apparatus.

These and other objects of the present invention, which will be appreciated when the attached drawing figures and following specification are considered, are accomplished by thermal purge apparatus which includes a discrete hermetic, closed-loop refrigeration circuit employing a refrigerant different from the relatively low pressure chiller system refrigerant.

Chillers typically comprise a hermetically sealed refrigeration circuit which conveys a first relatively low pressure refrigerant, referred to as the chiller refrigerant, through chiller components which include a condenser, an expansion valve, an evaporator and a compressor. The chiller system refrigerant undergoes a heat transfer relationship with water in the chiller evaporator so as to produce relatively cold water for further use in an industrial process or to comfort condition a building.

The purge apparatus of the present invention includes a discrete, hermetically sealed and separate closed-loop refrigeration circuit having a purge heat exchanger, referred to hereinafter as the purge cooling coil, that functions as an evaporator in a heat exchange relationship with the chiller refrigerant. The refrigerant used in the purge refrigeration circuit is a relatively high pressure refrigerant.

The purge cooling coil is disposed in a sealed enclosure (purge tank) the interior of which is in free-flow circulatory communication with the chiller condenser. Chiller refrigerant gas is drawn from and returned to the chiller condenser in a mechanically unassisted circulation process when the purge apparatus is operating. The chiller refrigerant gas entering the purge tank diffuses through drying elements disposed within the purge tank to remove moisture from the chiller refrigerant.

The chiller refrigerant gas and any water vapor remaining therein condenses on the relatively cold surface of the purge cooling coil and the condensed chiller refrigerant and water, if any, falls to the bottom of the purge tank. Air and other non-condensibles that separate from the chiller refrigerant in the process rise to the top of the purge tank while any separated water, in the liquid state, settles on top of the pool of condensed chiller refrigerant found at the bottom of the purge tank.

Condensed chiller refrigerant overflows back to the chiller condenser from the bottom of the purge tank leaving both moisture, air and other non-condensibles in the purge tank. The non-condensible gases are evacuated from the purge tank on a regular basis. The removal of air and other non-condensible gases from the purge tank is triggered by the blanketing of the purge system cooling coil by non-condensible gases (air) within the purge tank and the reduction in the transfer of heat to and temperature of the purge system refrigerant which results therefrom.

BRIEF DESCRIPTION OF THE DRAWINGS

FIG. 1 is a schematic diagram of the chiller system of the present invention.

FIG. 2 is a schematic diagram of the purge apparatus of the present invention.

DESCRIPTION OF THE PREFERRED EMBODIMENT

Figure 3:
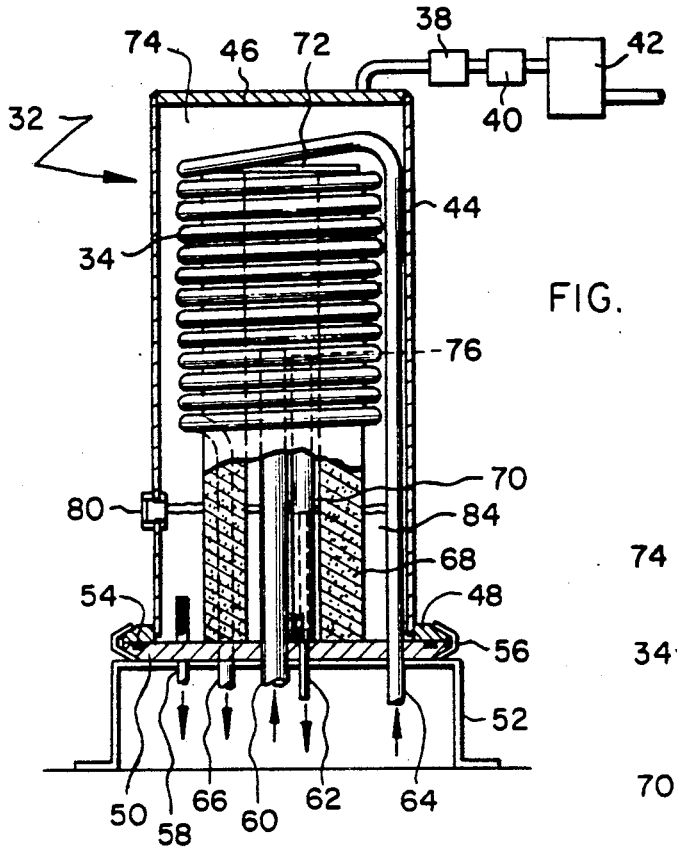
FIG. 3 is a partial cross-sectional view of the purge tank portion of the purge apparatus of FIG. 2 illustrating the components housed in the purge tank.

Referring initially to FIGS. 1 through 5. schematically illustrated is a refrigeration machine 10, commonly known as a chiller, the typical purpose of which is to provide chilled water for use in industrial processes or in the comfort conditioning of building structures. In the preferred embodiment, chiller 10 is a centrifugal chiller of the packaged type which includes a condenser 12, an expansion device 14, an evaporator 16 and a compressor 18.

Condenser 12, expansion device 14, evaporator 16 and compressor 18 are all serially connected to form a hermetically sealed closed-loop chiller refrigeration circuit which employs a low pressure refrigerant such as the refrigerant commonly known as R11. From FIG. 5 it will be appreciated that the use of such low pressure refrigerants, at certain times and under certain operating conditions, results in portions of machine 10 being operated at less than atmospheric pressure.

Because certain components, including the evaporator 16 and, under certain conditions, the condenser 12 of chiller 10, operate at lower than atmospheric pressure, it is possible for air and moisture to leak into the chiller. These non-condensible elements make there way to and become trapped in condenser 12 with the result that the condensing pressure and compressor power requirements increase thereby reducing chiller efficiency and cooling capacity.

In order to remove such non-condensibles, purge apparatus 20 is employed with chiller 10. As will be more fully described, purge apparatus 20 is connected in a free-flow circulatory relationship with condenser 12 of chiller 10 by supply and return lines **20*a* and 20*b* both of which open into a vapor space within chiller condenser 12**.

Referring primarily now to FIG. 2, purge apparatus 20 will be seen to include an entirely separate and discrete hermetic refrigeration circuit which employs a refrigerant different than the chiller system refrigerant. As will be more fully described, the refrigerant used in purge apparatus 20 is preferably a relatively high pressure refrigerant such as the refrigerant referred to as R12.

Purge apparatus 20 includes a refrigerant compressor 22 which is a component of purge system condensing unit 24. Condensing unit 24 also includes a fan 26 and a heat exchanger coil 28 to which compressor 22 discharges hot compressed purge refrigerant gas when the purge apparatus is in operation.

Fan 26, when operating, causes ambient air to move through coil 28 in a heat exchange relationship with the purge system refrigerant passing from compressor 22 to and through the purge condenser coil 28. It will be noted that while the use of an air-cooled purge condensing unit is preferred, as it avoids the need to "hook-up" to a different cooling source such as water, condensing unit 24 could be cooled by an alternate cooling source.

The condensed purge refrigerant next leaves coil 28 and passes to and through an expansion device 30. Expansion device 30, which functions as a suction pressure regulator, reduces the temperature of the purge system refrigerant to approximately 0° F. and maintains it there by regulating the pressure of the purge refrigerant to a target pressure.

The refrigerant next enters purge tank 32 which houses purge cooling coil 34, through purge coil inlet 64. As will be further explained, purge cooling coil 34 functions as an evaporator in the purge refrigeration circuit placing the relatively cold purge system refrigerant flowing therethrough into a heat exchange relationship with the relatively warm chiller system refrigerant vapor which is drawn into the purge tank. By the condensing of chiller system refrigerant on the purge cooling coil 34 the removal of non-condensibles from the chiller system refrigerant is accomplished internal of the purge tank.

After passing through cooling coil 34 and being vaporized in a heat exchange-relationship with chiller refrigerant in purge tank 32, the purge system refrigerant flows out of purge tank 32 through purge coil outlet 66 and back to compressor 22. As will also be further explained, the temperature of the refrigerant gas passing from coil 34 back to compressor 22 is sensed by a control switch 36 and is used in controlling the operation of purge apparatus 20 and the removal of air from purge tank 32.

FIG. 2 also illustrates the components of the pump-out portion of purge apparatus 20. The pump-out subsystem of purge apparatus 20 functions to remove air from purge tank 32 and includes a solenoid valve 38, a flow restrictor 40, such as a porous metal plug or capillary tube, and still another compressor, pump-out compressor 42. The function and operation of the pump-out system will likewise be discussed further hereinbelow.

Figure 4:
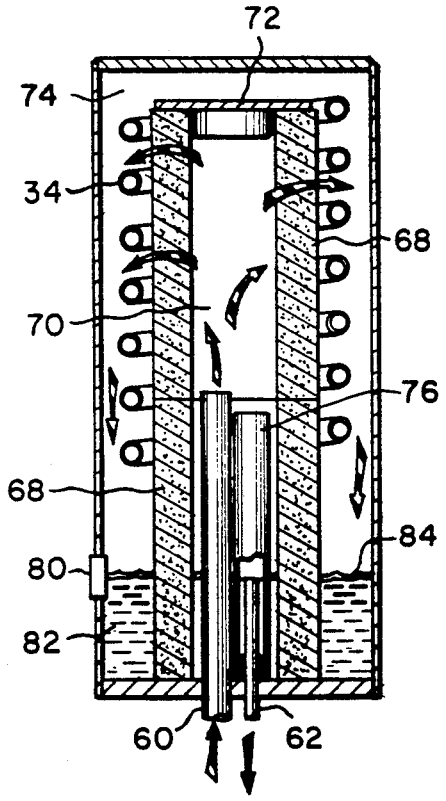
FIG. 4 schematically illustrates the purge tank of FIG. 3.
Figure 4A:
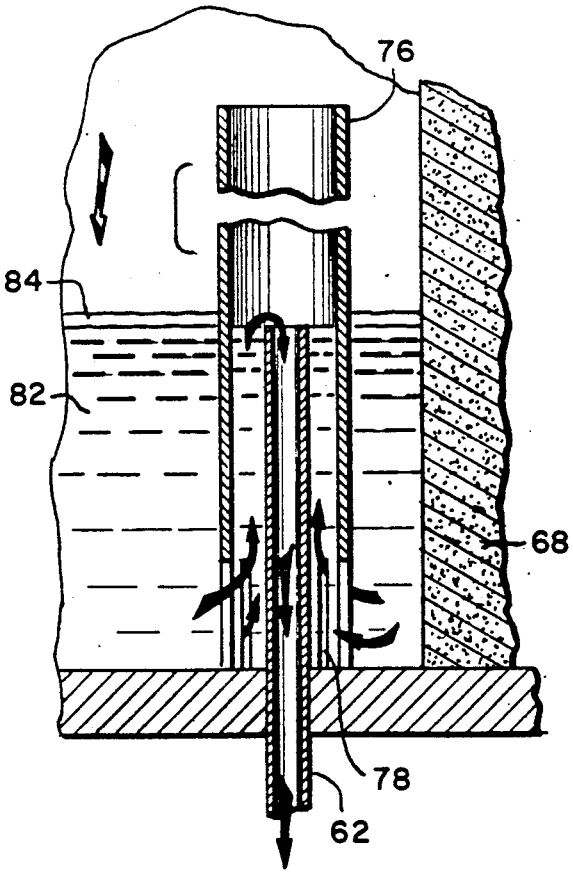
FIG. 4A is an enlarged portion of FIG. 4 illustrating the water separation tube inlet area within the purge tank of FIG. 3.

Referring primarily now to FIGS. 3, 4 and 4A, it will be appreciated that purge tank 32 consists of a cylindrical housing 44 closed at a first end by a top plate 46. A mounting flange 48 is disposed at the bottom of purge tank 32 for cooperative attachment to a base plate 50 which is mounted on purge system mounting frame 52. Purge system 20 can be mounted directly on or proximate to chiller 10.

An O-ring or gasket 54 is disposed between purge tank flange 48 and purge tank mounting plate 50 to create a seal therebetween. Gasket 54 is compressed between purge tank flange 48 and mounting plate 50 by the disposition and tightening of a V-band clamp 56 therearound with the result being that the interior of purge tank 32 is a volume which is closed off and sealed from the ambient. Opening into the interior of purge tank 32 is a tank drain 58 through which liquid within purge tank 32 will periodically be drained to allow for water removal and access to the components interior of the purge tank for purposes of servicing those components.

Chiller system refrigerant circulates from a vapor space in chiller condenser 12 through supply conduit **20*a* and into purge tank 32 through open-ended chiller refrigerant vapor supply conduit 60. As earlier noted, chiller refrigerant entering purge tank 32 through the open end of supply conduit 60 undergoes a heat exchange relationship with the purge system refrigerant flowing through purge cooling coil 34. As a result of this heat exchange process, chiller refrigerant condenses and falls, in the liquid state, to the bottom of purge tank 32**.

Condensed chiller refrigerant overflows into and is directed back to condenser 12 of chiller 10 through the open upper end of chiller refrigerant liquid return conduit 62 which connects to return conduit **20*b*. As is indicated above, return conduit 20*b* likewise opens into a vapor space in chiller condenser 12**.

It will be noted that purge tank 32 and chiller condenser 12 are connected by open ended supply and return conduit, i.e. supply conduit **20*a* which connects to open-ended inlet 60 in purge tank 34 and open-ended liquid return conduit 62 which connects to return conduit 20*b*. There is, therefore, preferably no mechanical restriction to or assistance in the circulation of chiller system refrigerant from, to, through or out of purge tank 34**.

The operation of purge system 20 relies on the thermal and pressure gradients between purge tank 32 and chiller condenser 12 which develop as a result of the heat exchange process which occurs in the purge tank. These gradients cause the natural circulation in a convection-like process, of chiller system refrigerant into, through and out of the purge tank.

Mounted within purge tank 32 are drier cores 68. Drier cores 68, which are commercially available porous moisture absorbing members, are generally tubular in nature and internally define a generally cylindrical volume 70. Cylindrical volume 70 is closed at its upper end by a top plate 72. Drier cores 68 and top plate 72 cooperate to define generally discrete volumes within purge tank 32 which can be generally characterized as a first volume 70 interior of the drier cores and a second volume 74 exterior thereof.

Extending upward from the bottom of purge tank 32 is a water separation tube 76 which, as is best illustrated in FIG. 4A, defines openings 78 in its lower portion. As will further be described, a pool of liquid chiller system refrigerant 82 will normally be found at the bottom of purge tank 32, below the lower end of purge cooling coil 34. A sightglass 80 is disposed in the sidewall of purge tank 32 at a level which coincides with the height to which open-ended chiller refrigerant liquid return conduit 62 extends upward into the interior of the purge tank. It will be noted that return conduit 62 extends upward and opens into the interior of water separation tube 76 within purge tank 32.

Figure 4B:
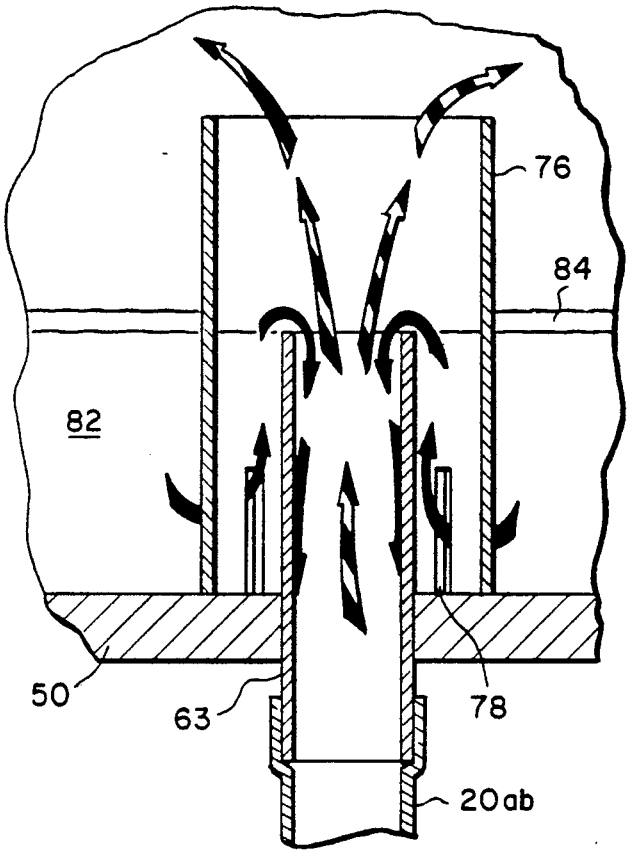
FIG. 4B illustrate an alternative chiller refrigerant supply and return arrangement employing a single supply/return conduit as opposed to the separate supply conduit and return conduits illustrated in FIGS. 1–4.

FIG. 4B illustrates an alternative embodiment wherein individual chiller refrigerant supply conduit 60 and individual chiller refrigerant return conduit 62 are replaced by a single chiller refrigerant supply/return conduit 63 and in which supply and return lines **20*a* and 20*b* are likewise replaced by a single supply/return conduit 20*ab*. In this embodiment chiller system refrigerant vapor is conducted into purge tank 32 through conduit 63 and is returned to condenser 12, in a liquid state, through that same conduit 63 by overflowing and running down the interior side wall of conduit 63 even as chiller refrigerant vapor circulates into the purge tank through supply/return conduit 63**.

Because the liquid level interior of purge tank 32 will not exceed the sightglass level, due to the fact that excess liquid refrigerant will overflow into liquid return conduit 62 (or 63) and will flow back to the chiller condenser, a view of the liquid at the sightglass level will indicate the existence of any water floating on top of the pool of liquid refrigerant which exists within the purge tank. The existence of a layer of water indicates the saturation of the drier cores and the need to replace them.

Referring concurrently now to all of the drawing figures, it will be appreciated that chiller system refrigerant vapor, which will, to varying degrees, carry with it water vapor, air and other non-condensibles, is drawn into purge tank 34 through suction gas inlet conduit 60 which opens into the interior of the purge tank above the liquid (sightglass) level therein. The chiller system refrigerant flows into volume 70 which is defined by top plate 72, drier cores 68 and the surface of the pool of condensed refrigerant 82 found at the bottom of the purge tank.

The chiller system refrigerant, together with the non-condensibles it carries into the purge tank, diffuse through the drier cores which serve to remove moisture from the chiller refrigerant. The chiller system refrigerant and any remaining water vapor then condenses on the surface of purge coil 34 and falls to the bottom of purge tank 32. Air, being a non-condensible, is displaced upward to the top of the purge tank. It will be noted that volume 70, which is defined interior of drier cores 68 and under top plate 72, is physically isolated from the portion of purge tank 32 where separated air is found.

If moisture is present in the liquid at the bottom of purge tank 32, the portion of drier core 68 disposed in the liquid at the bottom of the purge tank will function to remove the remaining moisture until such time as the drier cores become saturated. When the drier cores become saturated moisture will form as a liquid water layer on top of the condensed liquid refrigerant 82 found at the bottom of the purge tank.

This water layer will be apparent as a distinct liquid layer when viewed through sightglass 80. Any water which pools on top of condensed chiller system refrigerant 82 is prevented from returning to the chiller system condenser by water separation tube 76 which extends upward into volume 70 interior of the purge tank to an elevation above the water layer in the pooled liquid chiller refrigerant.

As has been noted, open-ended chiller system liquid refrigerant return conduit 62, which likewise extends upward into volume 70, opens into the interior of water separation tube 76. Water separation tube 76 defines inlets 78 at its bottom so that only liquid pooled at the very bottom of the purge tank is admitted into the interior of the water separation tube.

Because only liquid refrigerant will be found at the location of openings 78 of water separation tube 76 within the purge tank, only liquid refrigerant enters water separation tube 76 and is returned, through chiller system refrigerant liquid return conduit 62, to the chiller system condenser 12. Any liquid water will be maintained exterior of water separation tube 76 on top of pooled refrigerant 82 and will be isolated from the open end of chiller system refrigerant liquid return conduit 62 by the water separation tube.

As has been indicated, the purpose of purge system 20 is to remove air, water and other non-condensibles from the chiller system. Referring primarily now to FIGS. 6A, 6B, 6C and 7, it will be appreciated that when there is little or no air 86 interior of purge tank 34, purge coil 34 will be blanketed with chiller system refrigerant vapor 88. Purge coil 34 is sized such that when no air is present in the purge tank the surface area of coil 34 exposed to chiller system refrigerant vapor in purge tank 32 exceeds that which is required to produce a suction superheat in the purge system refrigerant circulating through the purge cooling coil given the operating parameters and characteristics of the expansion device 30. Therefore, when no air is present in purge tank 34, highly superheated purge system refrigerant gas is returned to the purge system condenser 28 by way of purge cooling coil 34 and compressor 22.

Purge system 20 is operational whenever compressor 22 and condensing unit 24 are energized. While condensing unit 24, which is cooled by ambient air, operates effectively over an ambient temperature range of from 40°–120° F., as ambient temperatures increase, the capacity of the purge condensing unit decreases thereby reducing the rate at which purge system 20 will remove air from purge system refrigerant. Assuming "normal" operational conditions of no air in the purge tank and a 70° F. ambient air temperature, hot, compressed purge system refrigerant gas is discharged from compressor 22 and is directed to heat exchanger 28.

Condensing unit fan 26 directs the 70° F. ambient air through heat exchanger 28 of condensing unit 24 in a heat exchange relationship with the purge system refrigerant. The purge system refrigerant exits purge system condensing unit 24 at a temperature of approximately 80° F. and is directed to expansion device 30 which functions as a suction pressure regulating device within purge system 20.

Expansion device 30 regulates the pressure of the purge system refrigerant to maintain an essentially constant pressure, on the order of 6 to 9 p.s.i.g., and constant temperature, on the order of 0 to −5° F., in the purge refrigerant at the inlet 64 to purge coil 34. The chiller system refrigerant vapor within purge tank 32 condenses on the surface of purge coil 34 and falls to the bottom of the purge tank. The condensing of the chiller system refrigerant within purge tank 32 creates pressure gradients between the purge tank and chiller condenser 12 thereby causing more chiller system refrigerant vapor, carrying non-condensibles and water vapor from condenser 12 to be drawn into purge tank 34 even as condensed chiller refrigerant overflows thereoutof and back to the chiller condenser.

When there is no air in purge tank 34 the purge system refrigerant returning to purge system compressor 22 from purge cooling coil 34 is at a high superheat level which corresponds to the saturation temperature in the chiller condenser. When the chiller is operating in the powered cooling mode this temperature is on the order of 80°–110° F. In the free cooling mode it can be as low as 40° F. During the heat recovery mode of chiller operation the saturation temperature will exceed 110° F.

The high superheat level of the purge refrigerant is sensed by temperature control switch 36. As air accumulates in purge tank 32, displacing chiller system refrigerant vapor within the purge tank, the effective purge coil surface exposed to chiller system refrigerant decreases due to the much less favorable heat exchange characteristics of the air as compared to those of the chiller system refrigerant. As a result, the available superheat to the purge system refrigerant is reduced as is the temperature of the refrigerant which is directed back to the purge system compressor.

Figure 6A:
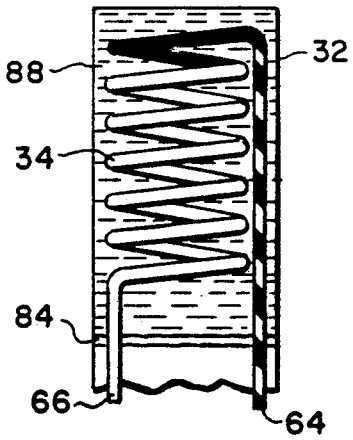
FIGS. 6A, 6B and 6C schematically illustrate the development of an air blanket within the purge tank.
Figure 6B:
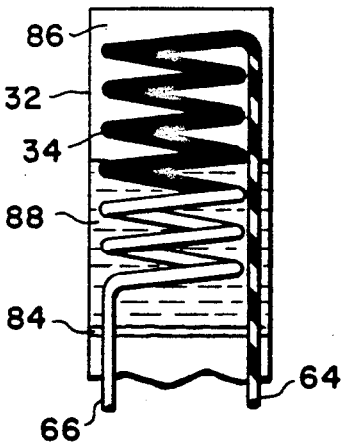
Figure 6C:
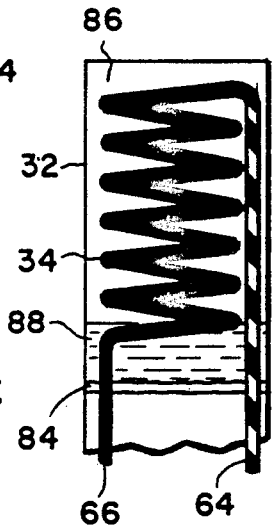
Figure 5:
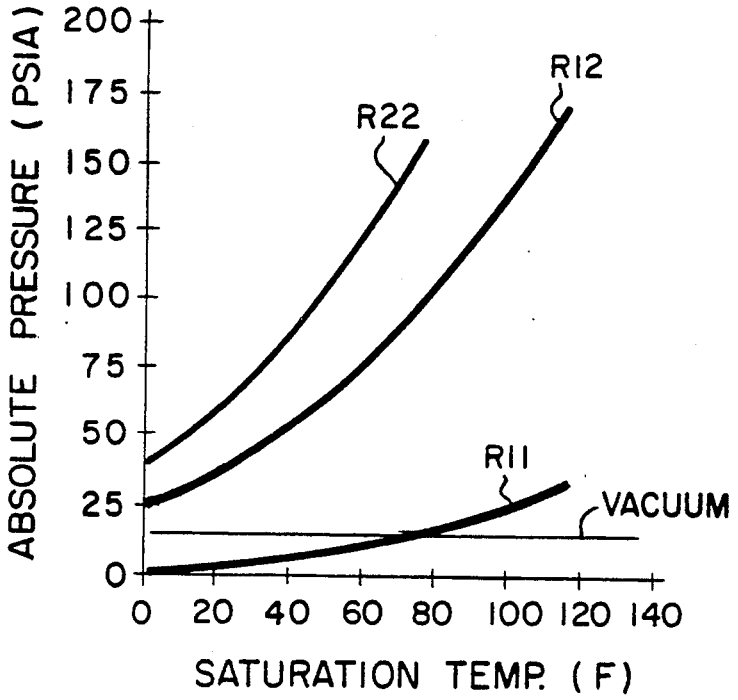
FIG. 5 is a graph illustrating temperature versus pressure curves for selected refrigerants.

As is schematically illustrated in FIGS. 6A, 6B and 6C, as air is separated from the chiller system refrigerant vapor 88, above liquid level 84 within the purge tank, more and more air blankets the outside coil surface of purge coil 34 starting at the top of coil 34 and moving downward through the purge tank. Since heat transfer from the purge refrigerant to the surrounding air is much less effective than that which occurs between the purge refrigerant and the chiller refrigerant in the purge tank, progressively less and less purge coil surface is available to superheat the purge system refrigerant flowing through the purge coil.

When the purge tank fills with air to the extent that essentially none of purge coil 34 is exposed to chiller system refrigerant, little or no superheating of the purge system refrigerant within coil 34 will occur. As a result, the temperature of the purge system refrigerant as it enters purge coil 34 through purge coil inlet 64 (0°to −5° F.) and as it exits the purge coil through return 66 for return to compressor 22 will be essentially unchanged when the purge coil is blanketed by air.

As is indicated in FIG. 2, the temperature of the purge system refrigerant returning from purge coil 34 to compressor 22 is sensed by temperature control switch 36 downstream of purge coil outlet 66. When the temperature of the purge system refrigerant returning to compressor 22 from purge coil 34 drops to a predetermined level, such as approximately 20° F. as sensed by the temperature control switch, a signal is generated by temperature control switch 36 which is used to energize solenoid 38 and pump-out compressor 42 which causes the evacuation of air from purge tank 34 through a pump-out process.

Figure 7:
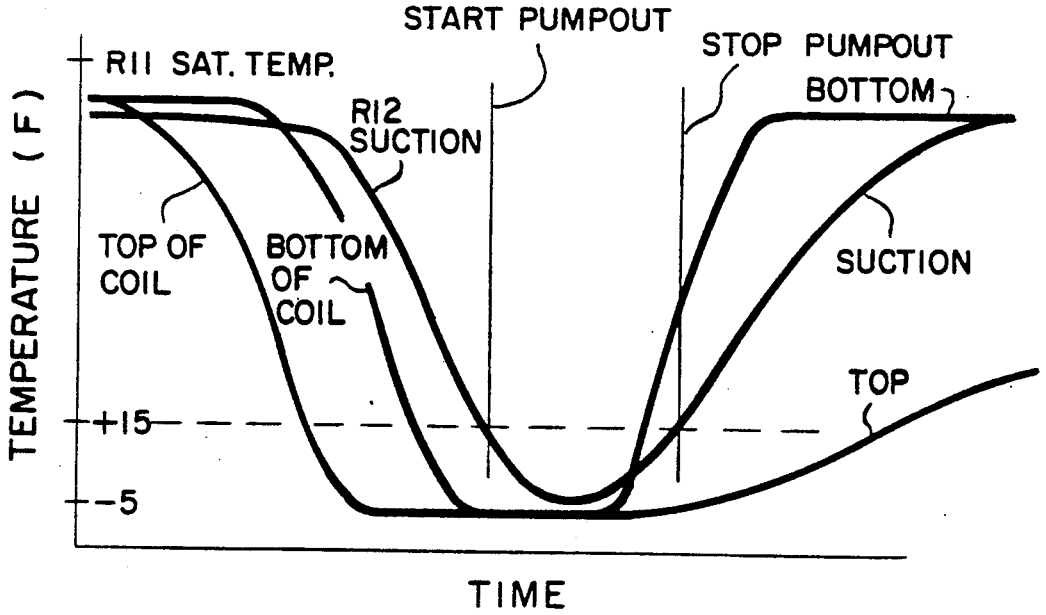
FIG. 7 is a graph illustrating certain purge system temperatures versus time during the operation of the purge apparatus of the present invention.

As the air is removed from the purge tank in the pump-out process, purge coil 34 is exposed to more and more chiller system refrigerant vapor which in turn causes the temperature of the purge system refrigerant being returned to the purge system compressor 22 to increase. Temperature control switch 36 senses the increased temperature of the purge system refrigerant and, when the temperature of the purge refrigerant increases to a predetermined level indicating the removal of the air blanketing the purge coil through the pump-out process signals for the closing of solenoid 38 and deenergization of pump-out compressor 42. FIG. 7 illustrates relative time versus temperature curves at various locations in purge apparatus 20 during the operation of the purge apparatus.

Solenoid 38 is used to seal purge tank 34 when the pump-out system is not activated and must seal the tank from a vacuum condition up to approximately 25 psig. Capillary tube or porous metal plug 40 is used to slow the venting action of the pump-out system. The controlled evacuation of air from the purge tank gives temperature control switch 36 time to more accurately track the changing heat transfer conditions inside the purge tank. The frequency of the occurrence of purge tank evacuation may also indicate the existence of an air leak into the chiller.

A timer control (not shown) may be added to the system which provides a means to override the pump-out system controls. Under most conditions purge tank pump-out lasts approximately 30 seconds. An override timer would close solenoid 38 and shutdown pump-out compressor 42 at a predetermined elapsed time should the pump-out compressor or temperature switch fail or if a large air leak developed within the chiller.

It should be re-emphasized that because purge system 20 preferably employs an air-cooled condensing unit and is a discrete hermetically sealed refrigeration circuit, it is capable of operation and of the purging of air from the chiller refrigerant whether the chiller is running or not and that no additional cooling source, such as water, is required. Purge unit 20 is also a departure from those purge systems which employ chiller system refrigerant from a location within the chiller, other than the chiller condenser, in a heat exchange relationship with chiller system refrigerant vapor from the condenser, to purge non-condensibles from the chiller refrigerant vapor. Such systems typically require that the chiller be in operation in order for the purge system to function.

While the present invention has been described in terms of a preferred embodiment, it will be appreciated that various modifications might be made to the invention without departing from its scope. The present invention should therefore not be limited to that apparatus described in detail above but is of a breadth consistent with the language of the claims which follow.

What is claimed is:

1. A method of purging non-condensibles, including air, from a water chiller which has a condenser comprising the steps of:

condensing chiller refrigerant in said chiller condenser;

providing a flow path from said chiller condenser to a purge tank;

disposing a heat exchanger in said purge tank, said heat exchanger being a part of a discrete purge refrigeration circuit, said purge refrigeration circuit employing a purge refrigerant which is different than said chiller refrigerant; and condensing chiller refrigerant on said heat exchanger in said purge tank in a heat exchange relationship with said purge refrigerant thereby causing the separation of non-condensibles from said chiller refrigerant and the circulation, in a free-flow manner, of chiller refrigerant from said chiller condenser into said purge tank due to the temperature gradients which develop between said chiller condenser and said purge tank as a result of said condensing step.

2. The method according to claim 1 comprising the step of operating all or portions of said chiller at subatmospheric pressure during certain normal modes of chiller operation.

3. The method according to claim 2 comprising the step of condensing said purge refrigerant in a heat exchanger relationship with ambient air prior to the step of condensing chiller refrigerant on said heat exchanger in said purge tank.

4. The method according to claim 3 further comprising the step of regulating the pressure of purge circuit refrigerant subsequent to the step of condensing purge circuit refrigerant in a heat exchange relationship with ambient air so as to establish and maintain an essentially constant predetermined temperature in said purge circuit refrigerant prior to the step of condensing chiller refrigerant on said heat exchanger in said purge tank.

5. The method according to claim 4 further comprising the steps of sensing the temperature of said purge circuit refrigerant subsequent to the step of condensing said chiller refrigerant on said heat exchanger in said purge tank; and initiating the evacuation of air from said purge tank when the temperature sensed in said sensing step falls below a predetermined temperature.

6. The method according to claim 5 further comprising the step of discontinuing said evacuating step when the temperature sensed in said sensing step increases to a predetermined temperature subsequent to said initiating step.

7. The method according to claim 6 comprising the step of operating said purge refrigeration circuit to purge non-condensibles from said chiller refrigerant when said chiller is de-energized.

8. Apparatus for removing non-condensibles from chiller refrigerant comprising:

a purge refrigeration circuit which employs a refrigerant different from said chiller refrigerant, said purge refrigeration circuit including a purge tank the interior of which is in free-flow communication with the interior of the chiller condenser, chiller system refrigerant circulating out of said chiller condenser and into and out of said purge tank as a result of pressure gradients which develop between the interior of said purge tank and the interior of said chiller condenser as a result of the operation of said purge circuit.

9. The apparatus according to claim 8 wherein components of said chiller, including said chiller condenser, are at subatmospheric pressure during certain modes of chiller operation.

10. The apparatus according to claim 9 wherein said purge refrigeration circuit includes a purge heat exchanger disposed in said purge tank and further comprising means for maintaining the pressure and temperature of said purge circuit refrigerant essentially constant at the inlet of said purge heat exchanger.

11. The apparatus according to claim 10 wherein said purge circuit includes a purge compressor and a purge condenser as well as means for evacuating non-condensibles from said purge tank and wherein said means for maintaining the temperature of purge refrigerant essentially constant at the inlet of said purge heat exchanger comprises a purge expansion valve, said purge compressor, said purge condenser and said purge expansion valve being hermetically connected in series with said purge circuit heat exchanger coil, said means for evacuating non-condensibles from said purge tank being activated in response to a drop in the temperature in the purge refrigerant, as it exits said purge heat exchanger, to a predetermined temperature indicative of the existence of a predetermined volume of non-condensibles in said purge tank.

12. The purge apparatus according to claim 11 wherein said purge circuit condenser is cooled by ambient air, said purge refrigeration circuit therefore being operable to condense chiller refrigerant in said purge tank independent of the requirement for a cooling source other than ambient air.

13. The apparatus according to claim 12 wherein the interior of said purge tank is in flow communication with the interior of said chiller condenser through separate supply and return conduits, said supply and return conduits opening into both said purge tank interior and into the interior of said chiller condenser.

14. The apparatus according to claim 13 wherein chiller system refrigerant condensed in said purge tank pools at to the bottom of said purge tank, in the liquid state, and wherein said chiller refrigerant return conduit extends upward and opens into said purge tank at a predetermined height, condensed chiller system liquid refrigerant overflowing into said return conduit and flowing therethrough back to said chiller system condenser when said purge refrigeration circuit is in operation.

15. The apparatus according to claim 14 wherein said means for evacuating non-condensibles from said purge tank includes a flow restrictor and a pump-out compressor both of which are isolated from the interior of said purge tank other than when said purge tank is being evacuated of non-condensibles.

16. The apparatus according to claim 15 further comprising means for preventing the return of water from said purge tank to said chiller condenser, said water return preventing means isolating the surface of condensed chiller refrigerant pooled at the bottom of said purge tank from said chiller liquid refrigerant return conduit.

17. The apparatus according to claim 16 further comprising a temperature switch, responsive to the temperature of purge circuit refrigerant exiting said purge heat exchanger, for initiating the evacuation of non-condensibles from said purge tank when the temperature of purge circuit refrigerant drops below a first temperature and for terminating the evacuation of said purge tank when the temperature of purge circuit refrigerant subsequently increases and exceeds a second predetermined temperature.

18. The apparatus according to claim 17 further comprising means for removing moisture from chiller system refrigerant which enters said purge tank entering in chiller system refrigerant vapor through said chiller refrigerant vapor supply conduit, all chiller system refrigerant entering said purge tank through said vapor supply conduit being constrained to interact with said means for removing moisture in a moisture removing relationship.

* * * * *